US005660302A

United States Patent [19]

Trout

[11] Patent Number: 5,660,302

[45] Date of Patent: Aug. 26, 1997

[54] REMOVEABLE PLASTIC PLUG WITH PULL RING

[75] Inventor: Stanley D. Trout, Huntington, Ind.

[73] Assignee: Rieke Corporation, Auburn, Ind.

[21] Appl. No.: 569,963

[22] Filed: Dec. 8, 1995

[51] Int. Cl.[6] ..... B65D 39/04; B65D 39/16

[52] U.S. Cl. ..... 220/790; 220/791; 220/254; 220/802; 220/DIG. 19; 215/296; 215/305

[58] Field of Search ..... 215/255, 295, 215/296, 298, 304, 305, 355; 220/307, DIG. 19, 352, 254, 269, 270, 785, 787, 788, 789, 790, 791, 793, 796, 798, 800, 801, 802, 805; 217/98, 110, 111, 113

[56] References Cited

U.S. PATENT DOCUMENTS

| | | | |
|---|---|---|---|
| D. 248,453 | 7/1978 | Summers . | |
| D. 263,799 | 4/1982 | Nilsson . | |
| 1,393,925 | 10/1921 | Townsend | 215/355 X |
| 2,699,370 | 2/1955 | Royall, Jr. | 215/355 |
| 3,080,088 | 3/1963 | Corrinet . | |
| 3,133,666 | 5/1964 | Henchert | 220/307 |
| 3,200,986 | 8/1965 | Grutta . | |
| 3,248,002 | 4/1966 | Song . | |
| 4,192,429 | 3/1980 | Yerman | 215/307 |
| 4,328,906 | 5/1982 | Walter . | |
| 4,399,927 | 8/1983 | Yaotani et al. | 220/307 |
| 4,431,110 | 2/1984 | Roth . | |
| 4,442,949 | 4/1984 | Dwinell et al. . | |
| 4,544,074 | 10/1985 | Evans | 215/355 |
| 4,674,649 | 6/1987 | Pavely | 220/270 X |
| 4,702,387 | 10/1987 | Wombold | 220/270 |
| 4,706,838 | 11/1987 | Von Holdt . | |
| 4,712,707 | 12/1987 | Pavely . | |
| 4,738,376 | 4/1988 | Markus . | |
| 4,747,511 | 5/1988 | Dutt et al. . | |
| 5,271,519 | 12/1993 | Adams et al. . | |

FOREIGN PATENT DOCUMENTS

| | | | |
|---|---|---|---|
| 640842 | 6/1962 | Italy | 215/298 |
| 6703031 | 9/1967 | Netherlands | 220/366.1 |
| 399292 | 3/1966 | Switzerland . | |
| 94/004422 | 3/1994 | WIPO | 220/307 |

*Primary Examiner*—Allan N. Shoap
*Assistant Examiner*—Nathan Newhouse
*Attorney, Agent, or Firm*—Woodard, Emhardt, Naughton, Moriarty & McNett

[57] ABSTRACT

A removeable plastic plug for a container having an annular outlet opening includes a unitary outer annular wall which is arranged with an annular upper lip portion, an annular lower rib portion, and an enclosing body portion which extends between the upper lip portion and the lower rib portion. The enclosing body portion defines a hollow interior which is sealed across by a closing diaphragm arranged in unitary construction with the enclosing body portion. The closing diaphragm includes an upwardly inclined portion to which a pull ring is attached. The outer annular wall further defines an annular receiving channel and a retention bead whereby the edge defining the outlet opening snaps into said annular receiving channel with the retention bead positioned on the underside of the defining edge. The lower rib portion is segmented by three equally spaced inverted V-shaped notches which are centered relative to the pull ring and which are disposed adjacent to the upwardly inclined portion. By means of the described construction, the plastic plug is able to be easily removed from the outlet opening by use of the pull ring.

14 Claims, 4 Drawing Sheets

REMOVEABLE PLASTIC PLUG WITH PULL RING

BACKGROUND OF THE INVENTION

The present invention relates in general to plastic plugs and closures which are removeable from their corresponding container by means of an integral pull ring. More specifically, the present invention relates to the design of a molded plastic plug for use with five-gallon (20 liter) containers which contain a paint product.

Five-gallon (20 liter) containers are typically used for non-tinted base paint products. These containers have an outlet opening which is closed by a suitable tint plug. When the painter acquires the initially filled container, the tint plug is removed and a paint tint is added. The tint plug is reinstalled, the paint constituents in the container are mixed, and the container is then transported to the job site. Typically these five-gallon paint containers (pails) are used by professional painters where the entire container with the lid removed adapts to their automatic paint application equipment.

Some of the problems with existing tint plug designs are that the plugs do not stay securely in the outlet opening when they are supposed to or the plugs are difficult to remove. There needs to be a balance which must be established between a tight fit for leak-proof handling and easy removal for the convenience of the user. The plug must remain secured in the outlet opening and establish a leak-proof seal during normal shipping and handling. The user, who may be unskilled, needs to be able to easily remove the tint plug without splashing paint which will be on the inside surface of the tint plug. Additionally, the tint plug must be easily reinstalled and effect a seal for transport between the tinting location and the job site.

The market for tint plugs is quite competitive and price is of utmost importance. In order to remain price competitive, tint plugs are typically molded from relatively inexpensive thermoplastic materials. The price constraints also limit the number of design options and features which can be incorporated into the tint plug.

In addition to those plug and closure designs described by the various patent references listed hereinafter, there are two current designs which are deserving of additional discussion. One design has a pull-ring connected to the bottommost horizontal surface of the cap. This design is intended to reduce the extraction force by collapsing the sidewall. As the horizontal surface is forced upwardly, its circumference tends to pull at the sidewall effectively trying to turn the basic cup-shaped configuration inside out. This is intended to reduce the diameter of the retention bead (a small circumferential ridge on the closure engaging the bottommost edge of the container opening) allowing the closure to be easily removed. It is believed that in actual practice, this particular concept does not work very well.

Another design which is appropriate of specific mention incorporates a pull ring which is attached to the inside of a vertical wall portion of the closure. The intent with this design is to collapse the sidewall in order to disengage the retention bead in one localized area. The next step with this particular design is for the closure to be "walked" or "rocked" off of the opening. While this concept may appear to be functional, the juncture of the pull ring and the sidewall forms a localized thick point. Special manufacturing precautions must therefore be made in order to ensure that this variation in wall thickness does not cause what is typically known as a "sink". A sink in the sidewall of the tint plug would be a leak path for the package lading.

The subject invention solves both problems inherent with these two existing designs. In the present invention the pull ring is molded to the bottommost portion (closing diaphragm) keeping the sidewall of uniform thickness, and thereby eliminating any sinks. The closing diaphragm has an inclined portion which angles upwardly as it extends outwardly. The pull ring is molded to this inclined surface at a location adjacent to the sidewall. This particular style of molded assembly enables a localized pressure to be exerted on the retention bead. The purpose is to deform the retention bead inwardly and rock the bead out through the container outlet opening. Once the retention bead is initially pulled away from the container outlet opening, the force required to rock the remainder of the bead is minimal. The critical area is the initial retention bead release from the outlet opening. As indicated, the angled portion of the closing diaphragm localizes the pull ring forces with respect to the retention bead. To further define and reduce the area where the retention bead initially releases from the outlet opening, it is desirable for the sidewall to deform or collapse in a controlled manner. In order to achieve this function, three inverted, generally V-shaped notches are provided in a lower rib portion of the sidewall. These three notches relieve the hoop strength which is inherent in the cylindrical sidewall design and contributes to an easier release of the retention bead from the outlet opening.

The present invention provides a tint plug which requires less force for removal while at the same time providing an enhancement to those portions of the design which prevent leaks. The present invention allows the retention bead to be made larger with respect to the sealing surface which is defined as the area between the retention bead and the bottom of the upper annular flange. This in turn improves the performance of the tint plug of the present invention during shipping and handling of the container.

In addition to the two designs described above, there are a variety of plastic plug and closure designs which have been patented over the years. Some of these patented designs include a pull tab or pull ring, while other designs incorporate features which are specifically styled for a particular need or problem. The following listed patents are believed to provide a representative sampling of these earlier patented plugs and closures:

| PATENT NO. | PATENTEE | ISSUE DATE |
|---|---|---|
| 5,271,519 | Adams et al. | Dec. 21, 1993 |
| 4,747,511 | Dutt et al. | May 31, 1988 |
| 4,712,707 | Pavely | Dec. 15, 1987 |
| 4,738,376 | Markus | Apr. 19, 1988 |
| 4,431,110 | Roth | Feb. 14, 1984 |
| 3,080,088 | Corrinet | Mar. 5, 1963 |
| 3,200,986 | Grutta | Aug. 17, 1965 |
| 4,706,838 | Von Holdt | Nov. 17, 1987 |
| 4,442,949 | Dwinell et al. | Apr. 17, 1984 |
| 4,328,906 | Walter | May 11, 1982 |
| 3,248,002 | Song | Apr. 26, 1966 |
| Des. 248,453 | Summers | Jul. 11, 1978 |
| Des. 263,799 | Nilsson | Apr. 13, 1982 |

Notwithstanding the variety of designs and concepts set forth in these various listed patents, the present invention is believed to be novel and unobvious in several respects.

SUMMARY OF THE INVENTION

A removeable plastic plug for a container having an annular outlet opening according to a typical embodiment of the present invention includes an axially-extending, unitary outer annular wall defining an annular upper lip portion, an annular lower rib portion, and an enclosing body portion extending between the upper lip portion and the lower rib portion, the enclosing body portion defining a hollow interior space, a closing diaphragm in unitary construction with the enclosing body portion and extending across the hollow interior space, the closing diaphragm having an upwardly inclined portion and the plastic plug further including a pull ring in unitary construction with the upwardly inclined portion.

One object of the present invention is to provide an improved removeable plastic plug for a container outlet opening.

Related objects and advantages of the present invention will be apparent from the following description.

DESCRIPTION OF THE PREFERRED EMBODIMENT

Figure 1:
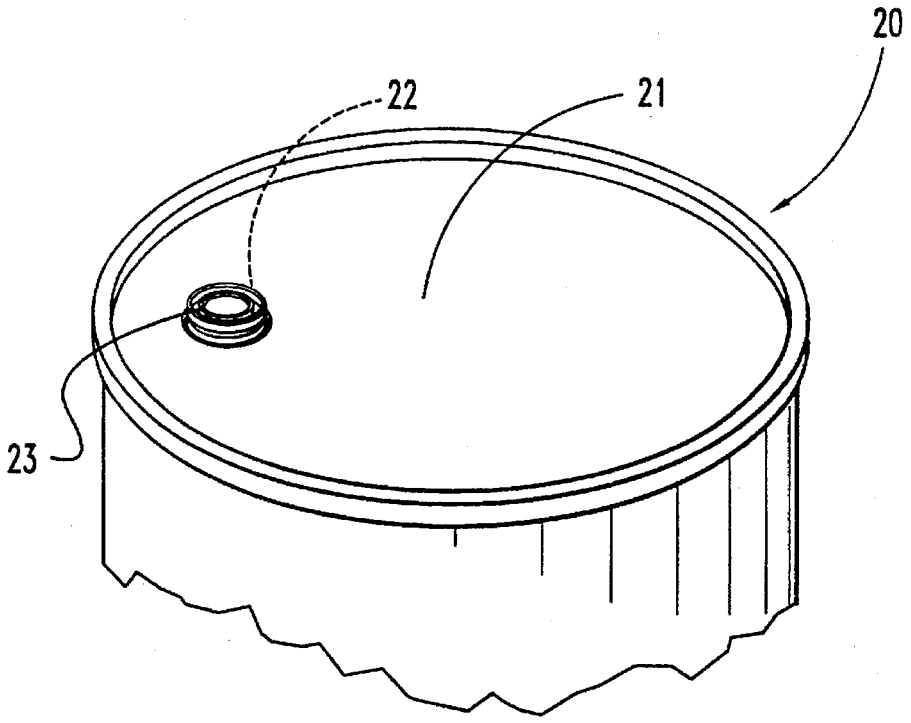
FIG. 1 is a perspective view of a plastic container having an outlet opening which is fitted with a removeable tint plug according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a five-gallon container 20 which is used for holding a non-tinted base paint product. The size of container 20 may also be referred to as a twenty liter container if a metric reference is used. Container 20 includes a removeable plastic lid 21 which defines a unitary, outlet opening 22. Outlet opening 22 while appearing to be substantially cylindrical actually has an upwardly diverging 20 degree taper on its side wall. Outlet opening 22 is fitted with an annular, plastic tint plug 23 which is designed according to the present invention. As will be described hereinafter, tint plug 23 is pressed into outlet opening 22 with a fluid-tight and secure fit. Tint plug 23 is designed to be removeable from the outlet opening 22 and to be reinstalled. There is a type of snap-fit assembly due to the sidewall design of tint plug 23 relative to the geometry of outlet opening 22. The upper, inner edge of opening 22 is radiused so as to make the insertion of tint plug 23 easier.

The plastic construction of the outlet opening 22 and of the tint plug 23 enable any slight out of round conditions or slight tolerance variations for these two components to be accommodated by flexing of one or both of these two components. In this manner the designed, snap-together, interference fit between the tint plug 23 and the outlet opening 22 can be maintained to the degree necessary to ensure a fluid-tight assembly.

Container 20 is typically used for a non-tinted base paint product which will have the desired tint added before transporting the container to the job site. Prior to adding the desired tint, it is important for the container 20 to remain sealed so that the non-tinted base paint does not leak out or otherwise become contaminated. In order to add the tint, tint plug 23 must be removed from the outlet opening 22. It is important to be able to easily remove the tint plug so that any paint on the inside surface of the plug does not splash out or spray or splatter onto adjacent exterior surfaces. After the tint is added, the tint plug 23 is reinstalled into outlet opening 22 by manually pushing the tint plug down into the outlet opening until it snaps into position and is fully seated. At this stage in the procedure, the paint constituents are mixed and the container is transported to the job site.

Figure 2:
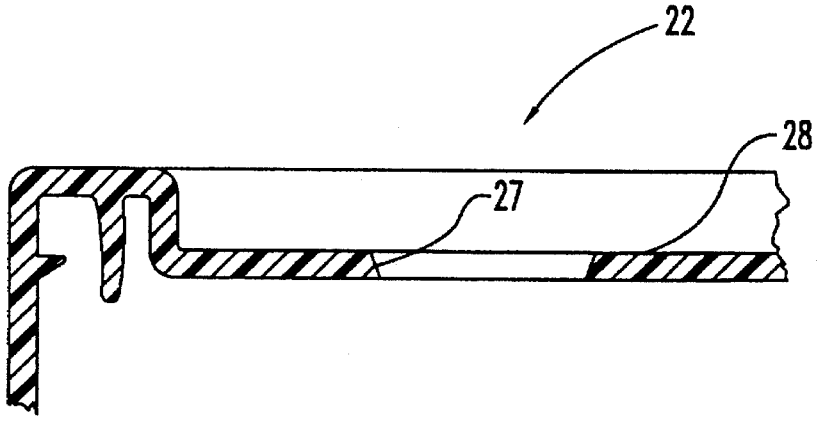
FIG. 2 is a side elevational view in full section of the FIG. 1 outlet opening.

Referring to FIG. 2, outlet opening 22 is illustrated in greater detail in full cross-section, including the outer edge portion of lid 21. Opening 22 is of unitary construction with the remainder of lid 21 and is of a molded plastic, construction. Outlet opening 22 is shaped with a smooth inner surface 27. The center portion 28 of lid 21 has a substantially uniform thickness whose axial dimension coincides with the axial length of opening 22.

Figure 3:
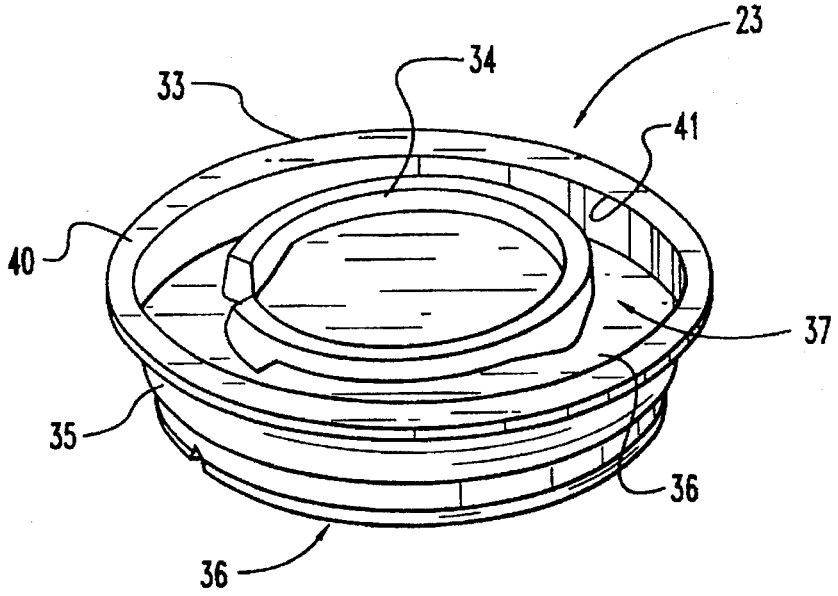
FIG. 3 is a perspective view of the FIG. 1 tint plug.
Figure 4:
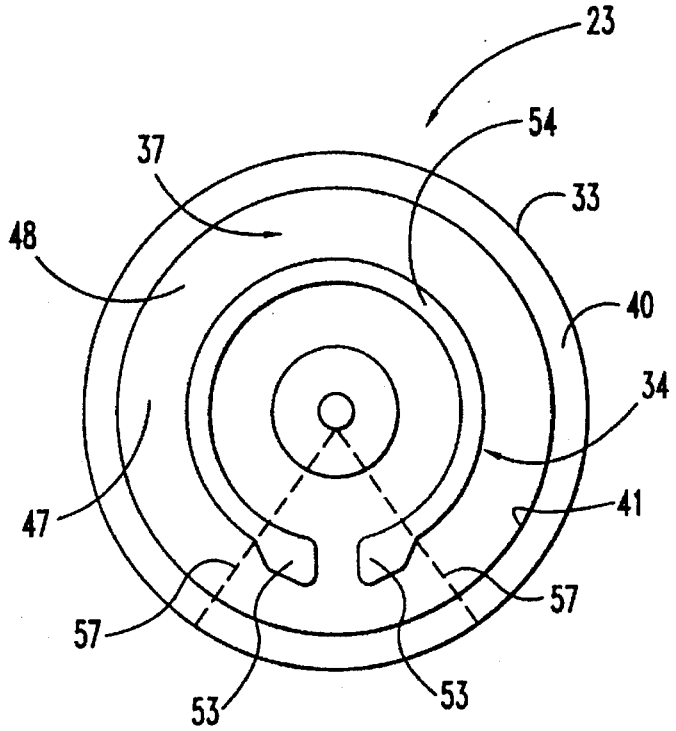
FIG. 4 is a top plan view of the FIG. 3 tint plug.

Referring to FIGS. 3–8, unitary, removeable tint plug 23 is illustrated in greater detail. In FIG. 3, a perspective view is provided wherein the tint plug 23 is oriented generally as it would be when installed in outlet opening 22 (see FIG. 8). Tint plug 23 is molded out of a polyethylene-based polymer and includes an annular upper flange 33, an interior pull ring 34, an annular outer sidewall 35, lower wall 36 which is arranged as a closing diaphragm, and interior clearance space 37. The upper flange 33 includes a planar upper surface 40 which extends inwardly to annular edge 41 which denotes the outer boundary of clearance space 37 and coincides with the upper edge of outer wall 35.

Outer wall 35 is uniquely shaped (see FIG. 6) with several defining surfaces beginning with inner surface **35*a* which extends from edge 41 downwardly and inwardly to its intersection with (lower wall) closing diaphragm 36. The slight inwardly converging taper of surface 35*a* gives this defining surface an inverted, truncated cone shape. Oppositely disposed to surface 35*a* directly beneath flange 33 is defining outer surface 35*b*. Surface 35*b* is substantially cylindrical and extends in an axial direction for approximately 1/16 inch which is approximately the same thickness as the center portion 28 of lid 21**.

Tapered (conical) surface **35*c* has a downward and inward angle of taper and radially extends beyond outer surface 35*b* so as to define a radially protruding lip 35*d*. Outer surface 35*b* extends between upper flange 33 and lip 35*d* and the radial extent of lip 35*d* creates an abutment edge and a snap-fit assembly of the tint plug 23 within the outlet opening 22. The inner surface 27 of outlet opening 22 fits securely against outer surface 35*b* and the thickness of center portion 28 is sized to be securely received between flange 33 and lip 35*d*. This assembly technique ensures a liquid-tight interface between the tint plug 23 and the outlet opening 22. Substantially cylindrical surface 35*f* axially extends for a short distance for approximately 180 degrees of the tint plug circumference. The axial length changes over the remaining 180 degrees due to the angled/inclined nature of lower wall (closing diaphragm) 36**.

Figure 6:
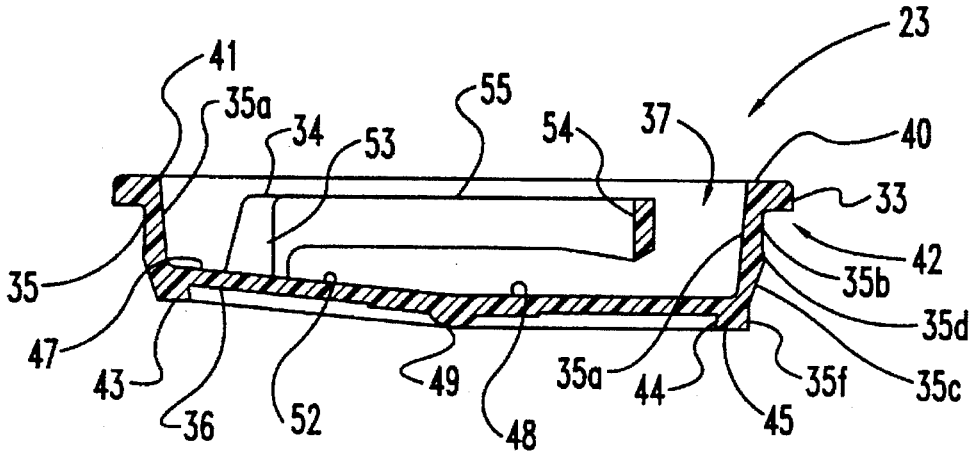
FIG. 6 is a side elevational view in full section of the FIG. 3 tint plug.
Figure 7:
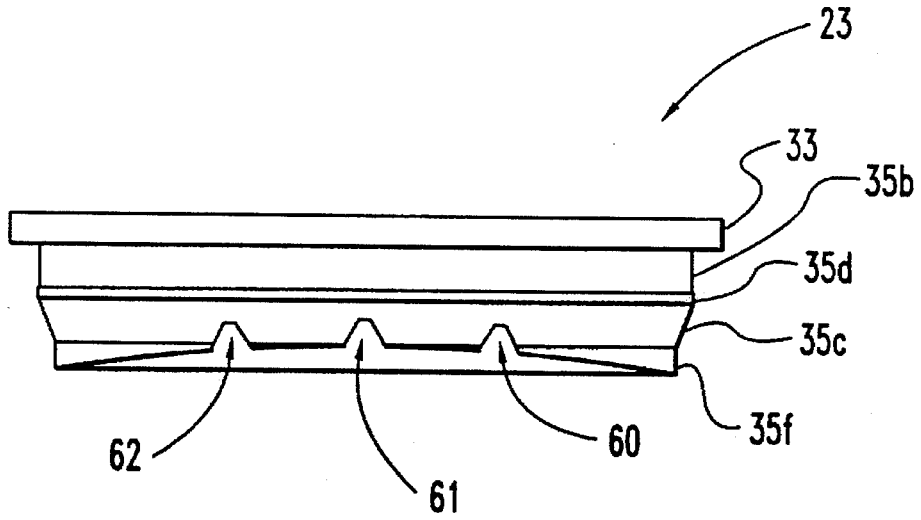
FIG. 7 is a front elevational view of the FIG. 3 tint plug.

As should be clear from the FIG. 6 illustration and the foregoing description, lip 35*d* creates a retention bead as part of outer wall 35. The axial location of lip 35*d* relative to the underside surface of flange 33 is the same over the entire circumference so that the snap-fit receipt is uniform over the entire circumference of plug 23. Flange 33 and lip 35*d* cooperate to define an inwardly directed annular channel 42 which receives that portion of lid 21 which defines outlet opening 22. The assembly of the tint plug 23 into outlet opening 22 is a snap-fit assembly with the underside surface of flange 33 in contact with the top surface of lid 21 and the lip 35*d* in contact against the underside surface of lid 21.

As tint plug 23 is inserted down into the outlet opening 22, there is a modest level of interference as the edge of the outlet opening 22 rides against conical surface 35*c*. The interference fit increases as the edge of the outlet opening 22 rides up against conical surface 35*c* in the direction of lip 35*d*. As lip 35*d* is reached, the continued downward force on the tint plug 23 forces the lip 35*d* to traverse the thickness of center portion 28 at which point the center portion snaps into the annular channel 42 in a secure and fluid-tight manner.

Annular lower rib 43 includes an annular inner wall 44 which is radially inset from outer wall 35*f* and is substantially concentric therewith. The annular lower surface 45 of lower rib 43 is not planar over its entire circumference due to the inclined configuration of closing diaphragm 36. The closing diaphragm (lower wall) 36 is configured with an inclined portion 47 and a substantially flat portion 48. These two portions intersect in the approximate geometric center of the tint plug 23. As such the plan view outline shape of each portion 47 and 48 is substantially semi-circular. The dividing line between portions 47 and 48 is a diametral line of lower wall 36. Centered in the bottom surface of lower wall 36 on the dividing line between portions 47 and 48 is raised projection 49.

While each of the portions of annular outer wall 35 have been described in some detail, and while annular flange 33 and lower rib 43 have also been described separately from outer wall 35, it should be clear from the description and illustrations that the tint plug 23 is of unitary construction throughout. Consequently, flange 33, sidewall 35, and lower rib 43 can all be considered as part of an annular sidewall for tint plug 23. The remaining portions of the tint plug would then include the closing diaphragm 36 which extends across the interior opening defined by the sidewall and the pull ring 34 which is integrally joined to the inclined portion of closing diaphragm 36. With a unitary construction, there are no specific edge or boundary lines to be drawn with regard to the specific portions and shapes which create tint plug 23.

Figure 8:
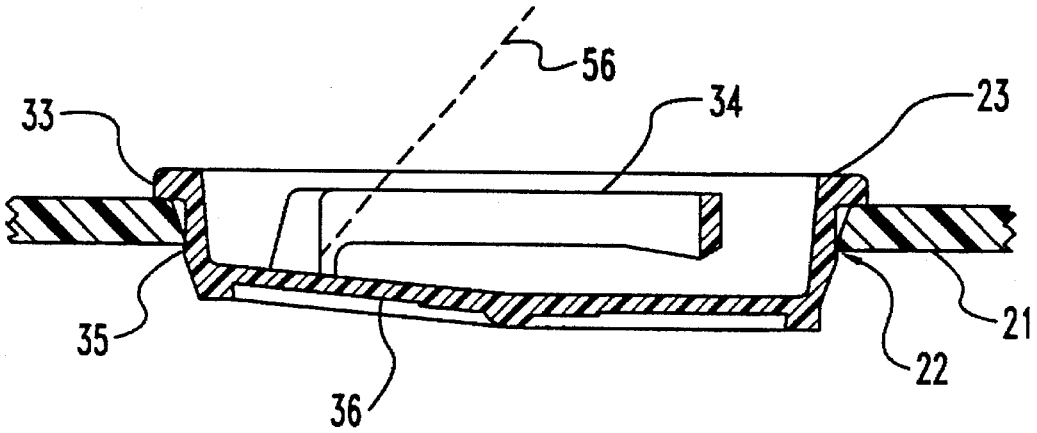
FIG. 8 is a side elevational view in full section of the FIG. 3 tint plug as installed into the FIG. 2 outlet opening.

Interior pull ring 34 is attached to the upper surface 52 of inclined portion 47. Due to the unitary construction of tint plug 23, pull ring 34 is molded as part of portion 47 and is thereby securely and rigidly attached. It should also be noted that the pull ring is joined to upper surface 52 at a location which would be regarded as adjacent to annular outer wall 35. Pull ring 34 is used to manually remove the tint plug 23 from outlet opening 22. Pull ring 34 includes two adjacent and substantially parallel connecting stem portions 53 which extend upwardly from upper surface 52 a short distance and then diverge to create and complete ring portion 54. Although the upper surface 52 of inclined portion 47 is inclined upwardly from its inner diametral edge to its outer semi-circular edge, stem portions 53 extend upward in such a manner so as to orient the ring portion 54 of pull ring 34 in a substantially horizontal direction based upon the normal in-use orientation of tint plug 23, as illustrated in FIG. 8, for example. The upper horizontal surface 55 of tint plug 23 is substantially parallel with planar upper surface 40 and positioned in a recessed manner within clearance space 37 below upper surface 40.

In order to remove tint plug 23 from its securely wedged assembly into outlet opening 22, the ring portion 54 of pull ring 34 is hooked with one or two fingers and pulled upwardly. The actual direction of pulling may vary somewhat from person to person, but the primary direction will be between a line drawn perpendicular to planar upper surface 40 and a line drawn parallel to surface 40. One possible pulling direction is along a line 56 (see FIG. 8) which is oriented at an approximate 45 degree angle in a clockwise direction. Any upwardly pulling direction between the perpendicular and parallel imaginary lines creates two force vectors which act on the tint plug due to the angled nature of inclined portion 47. This is true even if the upward pulling direction is near perpendicular to surface 40. One force vector will be vertical and the other force vector extends in a horizontal direction. The resultant force vector tends to pull the tint plug in a substantially horizontal direction away from the outlet opening and in a substantially vertical direction out of the outlet opening. What occurs is a unique interaction of forces which enables the tint plug 23 to be easily removed.

In view of the fact that there is a snap-fit assembly between the tint plug 23 and outlet opening 22, the initial step in removing the tint plug 23 from the outlet opening is to release the retention bead (lip 35*d*) from below the undersurface of lid 21. While brute force could be used, this could risk damage to the pull ring or damage to some portion of the retention bead which might create a leakage path when the tint plug is reinstalled in the outlet opening.

A typical pull ring and tint plug design would be arranged such that the ring is simply pulled in an axial direction and this approach requires a substantial pulling force as virtually the entire retention bead, over its full circumference, must be separated from the outlet opening in one action. In contrast, by means of the present invention, the unitary connection of pull ring 34 to inclined portion 47 creates a localized and angled force at one portion of the plug/outlet opening interface. The angular extent of this one portion where the force is localized measures approximately 60 degrees. As the pulling force is applied to pull ring 34, this force is transferred to the circumferential edge of the tint plug and to the corresponding retention bead 35*d* over an approximate 60 degree circumferential portion. This localized 60 degree portion of the tint plug and corresponding retention bead can be thought of as an initiating edge. This is the edge portion of the tint plug which begins the removal procedure and it is this localized 60 degree portion of the retention bead which initially separates from the outlet opening. In order to actually remove the tint plug 23 from the outlet opening 22, a starting or initiating edge portion of lip 35*d* must be pulled inwardly to clear inner surface 27. Once a portion of the lip 35*d* is freed, the remainder of the lip can be more easily removed. As the tint plug begins to separate and pull out of the outlet opening, continued pulling on the pull ring causes the separation and pull out of the plug to travel around the plug outer circumference moving along two paths, one each on opposite side of the initiating portion where plug pull out begins. It is the reduced, localized area where the plug initially releases which is achieved by the present invention. This localized area is bracketed by broken lines 57 in FIG. 4.

Figure 5:
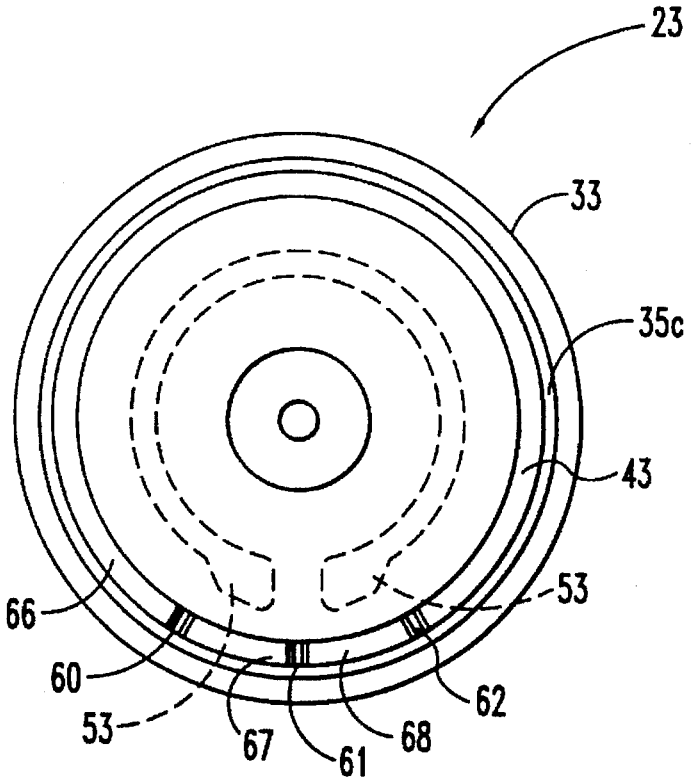
FIG. 5 is a bottom plan view of the FIG. 3 tint plug.

Positioned below the 60 degree portion as part of lower rib 43 are three equally-spaced, inverted V-shaped open notches 60, 61 and 62 (see FIG. 5). Each notch is molded upwardly into lower rib 43 and the radial depth of each notch extends completely through lower rib 43 from surface 35*f* to surface 44. The three notches are on equal 30 degree spacing for a circumferential span of 60 degrees. The center notch 61 is circumferentially centered between the two stem portions 53 and each stem portion 53 is circumferentially centered between a corresponding pair of open notches. These three notches allow the outer annular wall 35 of tint plug 23 to deform or collapse in a controlled manner. The deformation begins with lower rib 43. These notches relieve the hoop strength which is an inherent part of the annular sidewall design of tint plug 23. Additionally, these three V-shaped notches help to localize the area where the retention bead (lip 35*d*) initially releases from the outlet opening 22. These three notches segment the lower rib 43 into three sections 66, 67, and 68. The converging sides of each notch extend axially in the direction of flange 33.

The present invention reduces the amount of force required to remove the tint plug 23 from the outlet opening 22. As a consequence, the present invention permits the enhancement of those features which prevent leakage. The retention bead of the present invention can be made larger with respect to the sealing surface which is the area between the retention bead and the bottom of flange 33. This then improves the performance of the tint plug during shipping and handling of container 20.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A removeable plastic plug for a container having an annular outlet opening, said plastic plug comprising:

an annular flange which radially extends beyond said outer annular wall such that an overhanging lip is created;

an outer annular wall concentric to and in unitary construction with said annular flange, said outer annular wall defining a retention bead which is constructed for snap fit seating of said plastic plug into said outlet opening, said outer annular wall including a substantially cylindrical first wall portion joined to said annular flange, a frustoconical second wall portion, said second wall portion in cooperation with said first wall portion defining said retention bead and a substantially cylindrical third wall portion defining a lower rib which extends beyond a lower surface of said closing diaphragm, said lower rib being segmented into a plurality of sections by the presence of at least one open notch disposed in said lower rib;

a closing diaphragm recessed below said annular flange and being in unitary construction with said outer annular wall, said closing diaphragm having an inclined portion extending in a direction which is toward said annular flange and toward said outer annular wall; and a pull ring in unitary construction with said inclined portion, said pull ring located adjacent said outer annular wall.

2. The plastic plug of claim 1 wherein there are a spaced-apart plurality of open notches defined by said lower rib.

3. The plastic plug of claim 2 wherein there are a total of three spaced-apart open notches defined by said lower rib, each open notch having a substantially V-shaped configuration with converging sides axially directed toward said annular flange.

4. The plastic plug of claim 3 wherein adjacent notches of said three open notches are circumferentially spaced a distance of approximately 30 degrees and are located adjacent said inclined portion.

5. The plastic plug of claim 4 wherein said pull ring is joined to said inclined portion at a location circumferentially centered relative to said three open notches.

6. A removeable plastic plug for a container having an annular outlet opening, said plastic plug comprising;

an annular flange;

an outer annular wall concentric to and in unitary construction with said annular flange, said outer annular wall defining a retention bead which is constructed for snap fit seating of said plastic plug into said outlet opening, said outer annular wall including a substantially cylindrical first wall portion joined to said annular flange, a frustoconical second wall portion, said second wall portion in cooperation with said first wall portion defining said retention bead and a substantially cylindrical third wall portion defining a lower rib which extends beyond a lower surface of said closing diaphragm, said lower rib being segmented into a plurality of sections by a plurality of open notches disposed in said lower rib;

a closing diaphragm recessed below said annular flange and being in unitary construction with said outer annular wall, said closing diaphragm having an inclined portion extending in a direction which is toward said annular flange and toward said outer annular wall; and a pull ring in unitary construction with said inclined portion, said pull ring located adjacent said outer annular wall.

7. The plastic plug of claim 6 wherein said plurality of open notches are located adjacent said inclined portion and said pull ring is joined to said inclined portion at a location circumferentially centered relative to said plurality of open notches.

8. A removeable plastic plug for a container having an annular outlet opening which is defined by an annular edge, said plastic plug comprising:

an axially-extending, unitary outer annular wall defining an annular upper lip portion, an annular lower rib portion and an enclosing body portion extending between said upper lip portion and said lower rib portion, said enclosing body portion defining a hollow interior space, wherein said outer annular wall defines an annular receiving channel which is axially bounded by said upper lip portion and a retention bead, said annular receiving channel being constructed and arranged for snap-fit receipt of said annular edge and wherein said lower rib portion is segmented into a plurality of sections by a plurality of open notches disposed in said lower rib portion;

a closing diaphragm in unitary construction with said enclosing body portion and extending across said hollow interior space, said closing diaphragm having an upwardly inclined portion; and a pull ring in unitary construction with said upwardly inclined portion.

9. The plastic plug of claim 8 wherein said plurality of open notches are located adjacent said upwardly inclined portion and said pull ring is joined to said upwardly inclined portion at a location circumferentially centered relative to said plurality of open notches.

10. A removeable plastic plug for a container having an annular outlet opening, said plastic plug comprising:

an axially-extending, unitary outer annular wall defining an annular upper lip portion, an annular lower rib portion and an enclosing body portion extending between said upper lip portion and said lower rib portion, said enclosing body portion defining a hollow interior space;

a closing diaphragm in unitary construction with said enclosing body portion and extending across said hollow interior space;

a pull ring in unitary construction with said closing diaphragm;

said lower rib portion being segmented into a plurality of sections by at least one open notch disposed in said lower rib portion.

11. The plastic plug of claim 10 wherein there are a plurality of open notches located adjacent an initiating edge of said closing diaphragm and said pull ring being joined to said closing diaphragm at a location adjacent said initiating edge.

12. The plastic plug of claim 11 wherein said pull ring includes two spaced-apart stem portions which are joined to said closing diaphragm, wherein said plurality of open notches includes three equally spaced notches, each stem portion being circumferentially positioned between a different pair of adjacent open notches.

13. The plastic plug of claim 12 wherein said closing diaphragm includes an upwardly inclined portion, said upwardly inclined portion radially terminating in said initiating edge, said two spaced-apart stem portions being joined to said upwardly inclined portion.

14. In combination:

a plastic container for receipt and storage of a liquid substance;

an enclosing lid fitted to said plastic container, said enclosing lid defining an outlet opening; and a removeable plastic plug constructed and arranged for snap-fit assembly into said outlet opening, said plastic plug comprising:

an axially-extending, unitary outer annular wall defining an annular upper lip portion, an annular lower rib portion and an enclosing body portion extending between said upper lip portion and said lower rib portion, said enclosing body portion defining a hollow interior space;

a closing diaphragm in unitary construction with said enclosing body portion and extending across said hollow interior space;

a pull ring in unitary construction with said closing diaphragm; and said lower rib portion being segmented into a plurality of sections by at least one open notch disposed in said lower rib portion.

* * * * *